US005706956A

United States Patent [19]

Headrick et al.

[11] Patent Number: 5,706,956

[45] Date of Patent: Jan. 13, 1998

[54] OVERHEAD GUIDE CHANNEL STABILIZER MEANS FOR USE IN ASSOCIATION WITH PRODUCT MERCHANDISING DISPLAY UNITS

[75] Inventors: Jonathan L. Headrick, Overland; Keith Harbour, Florissant, both of Mo.

[73] Assignee: Paul Flum Ideas, Inc., St. Louis, Mo.

[21] Appl. No.: 549,979

[22] Filed: Oct. 30, 1995

[51] Int. Cl.[6] ..... A47F 7/00

[52] U.S. Cl. ..... 211/59.2; 211/74

[58] Field of Search ..... 211/59.2, 59.4, 211/162, 94, 94.5; 248/312

[56] References Cited

U.S. PATENT DOCUMENTS

| | | | |
|---|---|---|---|
| 2,919,814 | 1/1960 | Berkowitz | 211/74 |
| 4,801,025 | 1/1989 | Flum et al. | 211/59.2 |
| 5,450,971 | 9/1995 | Boron et al. | 211/134 |
| 5,531,336 | 7/1996 | Parham et al. | 211/59.2 |

*Primary Examiner*—Robert W. Gibson, Jr.
*Attorney, Agent, or Firm*—Haverstock, Garrett & Roberts

[57] ABSTRACT

An overhead guide channel stabilizer structure for use in cooperation with existing product merchandising display equipment so as to enable such existing equipment to more readily accommodate the merchandising of taller product containers therefrom, the present stabilizer structure being positionable within such existing equipment in spaced relationship above a product support area located therein and including a plurality of spaced, parallel guide members defining a plurality of guide channels therebetween for receiving and guiding the movement of the upper portions of product containers positioned therebetween and supported on the product support area located therebelow. The present stabilizer structure is easily mounted within existing display equipment, including refrigerated display coolers and other types of product merchandising display devices having a wide variety of different product support areas and other shelf constructions associated therewith; it provides sideward support for the product containers positioned therebetween to prevent such containers from falling over; it functions to guide the movement of product containers in orderly rows on the product support area located below; it includes an adjustment mechanism for varying the height of the stabilizer structure above the product support area depending upon the particular height of the product containers to be dispensed therefrom; it can be conveniently mounted in either a flat substantially horizontal position or in an inclined position for gravity feed operation; and it may also include frangible side portions which can be easily detached for adjusting the width of the overall structure to facilitate use in existing display equipment having varying width dimensions.

15 Claims, 5 Drawing Sheets

OVERHEAD GUIDE CHANNEL STABILIZER MEANS FOR USE IN ASSOCIATION WITH PRODUCT MERCHANDISING DISPLAY UNITS

The present invention relates generally to product display devices for use in storing and merchandising shelved products therefrom, and, more particularly, to an overhead guide channel stabilizer means adaptable for use in cooperation with existing product merchandising display equipment, the present stabilizer means being mountable and suspendable within such existing display equipment in spaced relationship above one or more of the product holding shelf members or other support areas commonly associated therewith. The present stabilizer means includes a plurality of guide channels for receiving and guiding the upper portions of product containers positioned and supported on the particular product holding support area located therebelow, each guide channel providing lateral support for taller product containers positioned therebetween so as to prevent such taller products from tipping or toppling over into adjacent products or into adjacent channels as such products are removed from the product holding support area. The present stabilizer means also serves to guide and direct the movement of the product containers on the product holding support area in an orderly fashion, namely, in parallel rows. Although the present guide stabilizer structure is primarily designed for use in a multitude of different types of refrigerated display coolers and other types of cold vaults commonly utilized in supermarkets, convenience stores, and other food and beverage outlets, it is likewise adaptable for use in many other display shelf applications.

BACKGROUND OF THE INVENTION

A wide variety of product merchandising display devices including guide or divider wall means forming channels for containing and guiding the movement of products positioned thereon and therebetween have been designed and manufactured for use in merchandising products to consumers. See, for example, the display units disclosed in U.S. Pat. Nos. 4,801,025; 4,454,949; and 4,478,337; all of which patents are owned by Applicants assignee. Such known display units were specifically designed for merchandising soft drink and fruit juice products in smaller individual serving containers and, as such, the guide channel or divider wall means associated with such known units are relatively short and function more to contain and control the movement of the product containers by engaging only the bottom or lower portions of the product containers as compared to the top portions thereof. The smaller soft drink and fruit juice containers for which these known display units were originally designed to accommodate are also relatively stable containers, even when inclined in a gravity feed orientation, and these smaller containers, when merchandised from the known units, have little tendency to tip or fall over.

Changes in consumer tastes have now caused an evolution towards taller product containers, especially taller soft drink and fruit juice containers, which taller containers tend to be more top heavy and more unstable than the previous containers. A problem which has now been encountered with the known prior art display devices and, in particular, when merchandising products therefrom in a gravity feed application, is that such taller products now have a greater tendency to tip over the relatively low guide or divider wall means and such taller containers also have a greater tendency to tip over within their respective channels. Contributing to this problem is the increased use of less stable bottom wall container configurations for packaging such beverage products, such as the petaloid bottom presently used on newer 20 oz. single serve soft drink bottles.

The above discussed problems have led to increased product breakage and loss; it has lessened the attractiveness of the product displays; and it has required more frequent sorting and organizing of the shelved products to enable the free flow of products in gravity feed applications. This problem has also been found to impede easy access to the products located on the individual shelf members.

Various means have been designed to alleviate the above described problems associated with the prior art product merchandising display units, most of which means generally comprise the use of taller guide channel divider means. See, for example, U.S. Pat. No. 5,351,838 which discloses improved product guide channel divider means that can be incorporated into new product merchandising display units, or which can be retrofitted onto existing units, to provide flexible, lateral support for merchandising taller products without binding, squeezing or otherwise hindering the product flow. Nevertheless, such improved guide channel divider means, since they are relatively tall, can still interfere somewhat with product visibility. Also, retrofitting these divider means onto existing units often entails unloading and/or removing shelf members from a display unit and thereafter attaching a plurality of the improved guide means to each of the shelf members associated with such unit, which retrofit operation not only takes the product holding shelves out of service temporarily, but it can also be labor intensive. For these and other reasons, solutions to the above-described problems have met with limited success in certain applications.

SUMMARY OF THE INVENTION

The present invention overcomes many of the disadvantages and shortcomings associated with known product merchandising display devices and teaches the construction and operation of several embodiments of an overhead guide channel stabilizer means specifically designed for use in cooperation with many existing product merchandising display units such as known refrigerated display coolers, cold vaults, and other product display applications commonly utilized for merchandising a wide variety of products such as soft drinks, juices, diary products and so forth in supermarkets, convenience stores and the like. The present stabilizer means is mountable or suspendable within such existing coolers or other display units in spaced apart relationship above existing product support areas or shelving associated therewith and functions in cooperation therewith to provide lateral support and guidance to the product containers positioned on the existing shelving therebelow. More specifically, the present stabilizer means includes a plurality of spaced, parallel guide members defining a plurality of adjacent guide channels adaptable for receiving and guiding the upper portion of product containers positioned therebetween such as the upper neck portion of soft drink bottle containers and the like. As will be further explained, the present stabilizer means can be supported in either a horizontal orientation, or in a inclined orientation for gravity feeding products positioned on the shelf support area therebelow, and it is capable of containing and guiding the movement of relatively tall products, such as 20 oz., 1, 2 and 3 liter soft drink containers and the like. In this regard, the present guide channel stabilizer means serves to prevent such taller products from falling or toppling over thereby enhancing the free flow of products, particularly in a gravity feed application.

Importantly, a large number of existing product merchandising display units are suitable sizewise for use with the newer, taller products discussed above. However, such existing units lack adequate stabilization means for such taller products and, as noted above, such taller products have a propensity for toppling over. The present guide channel stabilizer means can be easily and quickly installed for use with a wide variety of different existing display unit constructions to provide additional stabilization means for such existing units. In this regard, the present stabilizer means is easily mounted within existing display equipment through the use of suspension cords and hooks and includes an adjustment mechanism for varying the height of the stabilizer structure above the shelf support area below so as to properly position the stabilizer means depending upon the particular height of the product containers to be merchandised therefrom. This enables existing units which could not otherwise accommodate the dispensing of the taller product containers therefrom to be easily retrofitted to accomplish this task. Furthermore, the present guide channel stabilizer means can be incorporated into existing product merchandising display units while such units are in use and still stocked with products, and without requiring removal of the products therefrom. The present stabilizer means are also compatible for use with the many different types of product support areas associated with the many different types of refrigerated and unrefrigerated product display units such as with the wide variety of different types of shelf organizers and other product merchandising shelf constructions, both divided and undivided organizing units; with wire or rod-type grid units; and with any type of substantially flat, planar product support floor members.

The present guide channel stabilizer means can also be provided with frangible means enabling one or more side portions thereof to be separated and/or broken off so as to enable the stabilizer means to fit a particular display application, the frangible side portions being detachably removable for adjusting the width of the overall stabilizer structure to facilitate use in existing display equipment having varying width dimensions. It is also recognized that the size and shape of the present guide stabilizer means including the individual guide members and the space between each respective guide channel can be resized to not only meet the specific requirements of any particular merchandising application, but also to accommodate any particular product container such as 20 oz., 1, 2 and 3 liter soft drink bottle containers presently utilized by the soft drink industry. Unlike the prior art guide or divider wall means used to control the movement of taller products which engage the product containers below the neck or cap area such as the guide channel divider means disclosed in U.S. Pat. No. 5,351,838, the present invention is specifically designed to control and capture the upper end portion of the product containers such as the upper neck or cap portion thereof. This provides more stability to taller product containers and further obviates the possibility that such taller product containers will fall or topple over. Because the present stabilizer structure is versatile and can be used in conjunction with a multitude of existing product display equipment, the present invention represents a one-inventory solution to a user enabling such user to merchandise taller products from any type of existing product support area currently in use.

OBJECTS OF THE INVENTION

It is therefore a principal object of the present invention to provide overhead guide channel stabilizer means adapted for use with existing product merchandising display equipment for containing and guiding the movement of relatively tall product containers in convenient parallel rows for easy access and removal.

Another object is to provide means for stabilizing and guiding the movement of relatively tall products in existing display equipment without obstructing product accessibility and/or visibility.

Another object is to provide guide channel stabilizer means which can be easily and quickly installed within existing display units, including refrigerated display coolers, without dismantling the display unit and without removing products therefrom.

Another object is to provide means for containing and guiding the movement of relatively tall products which can be easily retrofitted to existing units and which are relatively simple and inexpensive to manufacture.

Another object is to provide guide channel stabilizer means which are adjustable for varying the height thereof above a particular product support area depending upon the height of the product containers to be dispensed therefrom.

Another object is to teach the construction and operation of an overhead stabilizer structure which can be easily installed in cooperation with existing shelving in either a substantially horizontal position or in an inclined position for gravity feed operation.

Another object is to provide guide channel stabilizer means which may include frangible means for varying the width of the overall structure to facilitate use in existing display equipment having varying width dimensions.

These and other objects and advantages of the present invention will become apparent to those skilled in the art after considering the following detailed specification of several preferred embodiments of the present invention in conjunction with the accompanying drawings wherein:

DETAILED DESCRIPTION OF THE PREFERRED EMBODIMENTS

Figure 1:
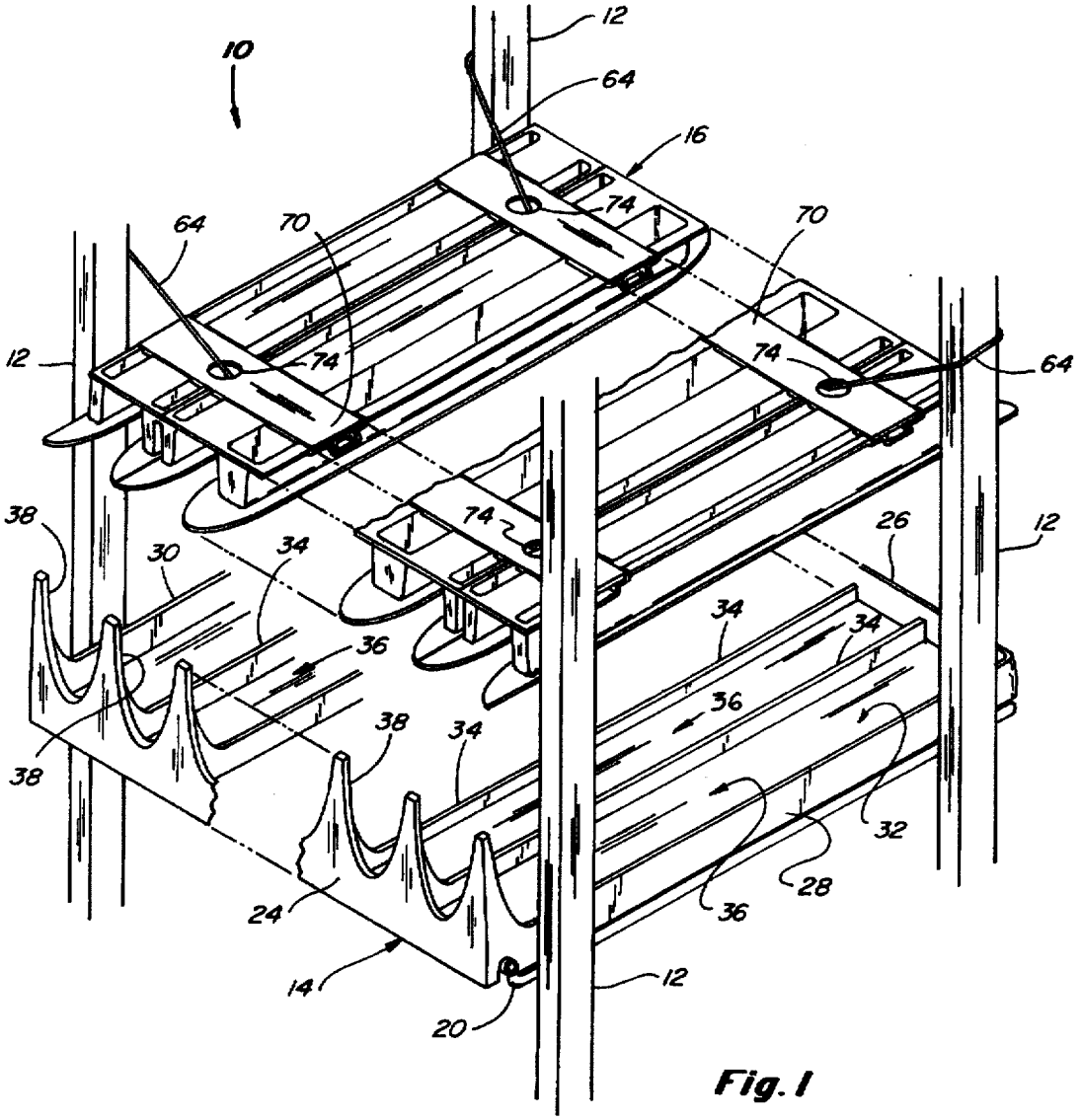
FIG. 1 is a fragmentary perspective view of the present overhead guide channel stabilizer means constructed according to the teachings of the present invention, the present stabilizer means being shown in its installed position over a shelf member associated with a typical prior art product merchandising display unit.

Referring to the drawings more particularly by reference numbers wherein like numerals refer to like parts, number 10 in FIG. 1 identifies a typical prior art product merchandising display unit utilizing overhead guide channel stabilizer means constructed according to the teachings of the present invention in association therewith. The product merchandising display unit 10 is designed to support and merchandise products positioned thereon such as bottled and/or canned soft drink products and the like and is representative of the construction associated with many existing display units including refrigerated display coolers, visi-coolers and other types of cold vaults. The display unit 10 includes a plurality of spaced, upstanding support members 12 positioned in supportive relation to at least one product support area or shelf member 14. The present guide channel stabilizer member 16 is shown located in spaced relationship above shelf member 14 to provide lateral support for such products while still enabling such products to freely move on shelf member 14 in orderly rows as will be hereinafter explained.

Upstanding support members 12 and shelf member 14 are both of conventional construction representative of a wide variety of such members presently in use in a wide variety of product merchandising display units. Therefore, it should be recognized that the present invention is in no way limited to usage only with the product merchandising display unit 10. The upstanding support members 12 of unit 10 are typical of the type of vertical support means utilized in many of the known load carrying rack assemblies such as the ARDCO, ANTHONY and STYLELINE systems currently in use throughout the industry. Each upstanding support member 12 is of rectangular, tubular construction and may include a plurality of spaced hooks, openings or other similar attachment means formed through one or more side surfaces thereof at spaced intervals along the length of the member such as the vertical spaced slots or openings 18 illustrated in FIG. 4. Upstanding support members 12 are attached in supportive relationship to shelf member 14 using a wide variety of conventional means such as hooks, clamps and the like. Shelf member 14 can be attached to each upstanding support member 12 in either a substantially flat horizontal orientation, or in an inclined orientation for gravity feed type operations.

The illustrated shelf member 14 is also of known construction representative of a wide variety of members providing a product support area for receiving and holding a plurality of products thereon. Shelf member 14 is positioned in overlaying relationship to an underlying shelf support structure 20 and includes spaced front and rear edges or walls 24 and 26, spaced side edges or walls 28 and 30, and a floor portion 32 which extends substantially the full length and width of the shelf 14 between the front, rear and side walls thereof. A plurality of spaced upstanding shelf divider wall portions or guide members 34 extend the entire length of shelf member 14 between front and rear walls 24 and 26 to divide floor portion 32 into a plurality of parallel channels 36 for supporting products positioned thereon in parallel rows. It is important to note that shelf divider walls 34 are relatively short in height and are representative of shelf divider walls of a wide variety of known shelving structures. Front wall 24 is shaped so as to form a plurality of inverted arches 38 defining a plurality of openings therethrough, each inverted arch 38 being positioned respectively adjacent the front edge portion of each product channel 36. The inverted arches 38 serve as a forward stop means for holding and retaining products positioned within the respective channels 36 until such products are removed therefrom. It is recognized that a wide variety of other front wall shapes and designs as well as a wide variety of other suitable forms of stop means can be utilized across the front portion of existing prior art shelf structures so as to hold and retain products positioned thereon in both a gravity feed orientation as well as in a flat, horizontal orientation. Shelf support structure 20 for supporting shelf member 14 is also of known construction and may include an open grid type construction formed of wire, tube and/or rod members capable of supporting shelf 14 with a plurality of products positioned thereon.

It should be recognized that the prior art product merchandising display unit 10 described above, as well as other prior art display unit constructions, tend to suffer from many of the problems discussed above when it comes to merchandising the taller product containers presently being utilized in the marketplace such as the taller 20 oz. single serve soft drink containers discussed above. In other words, the relatively low divider walls 34 as well as the lower side walls 28 and 30, which wall members are representative of many of the existing prior art display shelf constructions presently in use, provide inadequate lateral support and guidance for relatively tall product containers positioned therebetween so that such taller products can easily tip over the side edge of such prior art display units or into adjacent product channels as previously explained above. The present guide channel stabilizer member 16 includes product channel guide means which are specifically directed to containing and guiding the movement of relatively tall product containers positioned therebelow, including the 20 oz. petaloid soft drink container as well as the 1, 2 and 3 liter soft drink containers.

Figure 2:
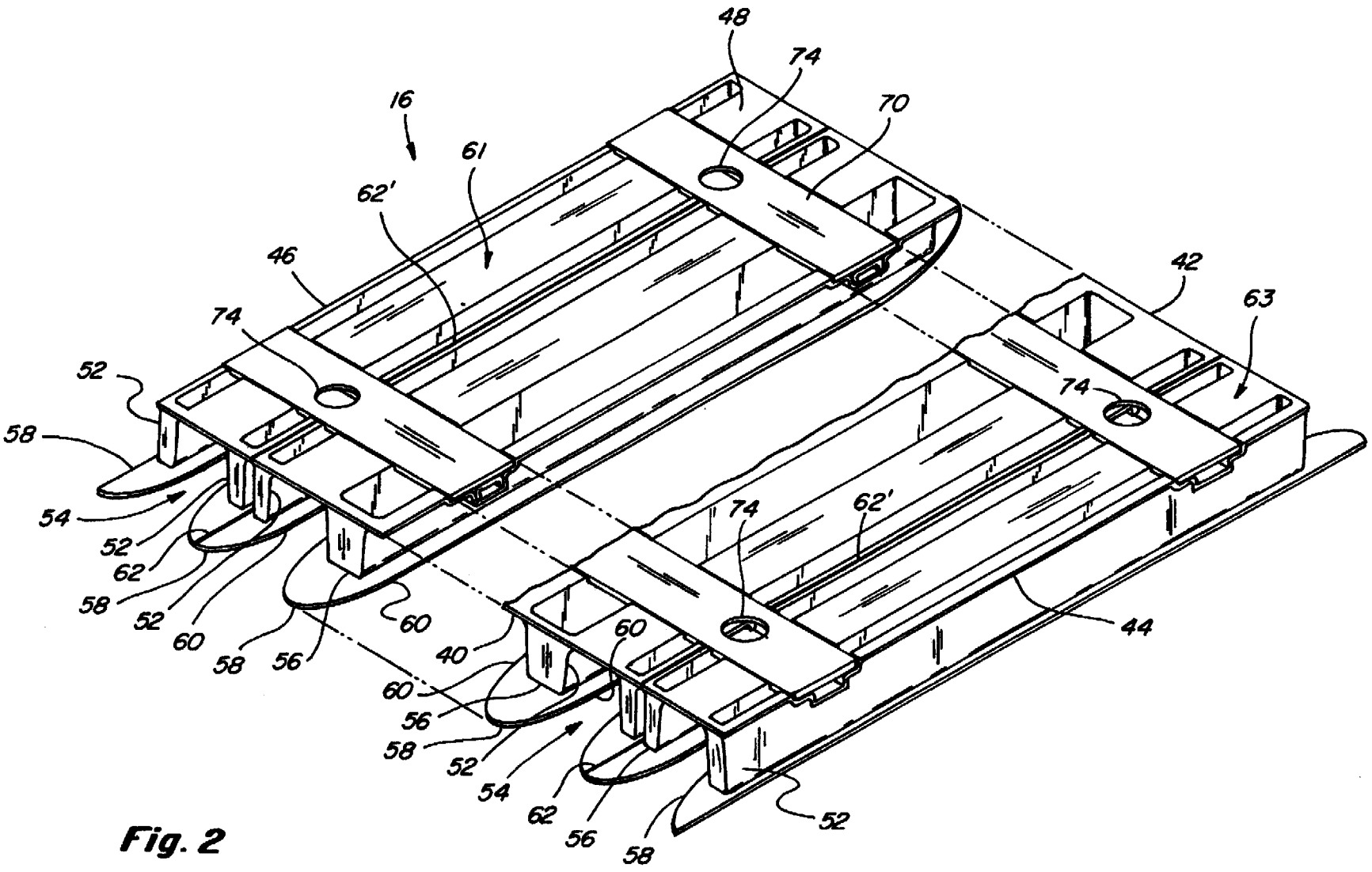
FIG. 2 is an enlarged fragmentary perspective view of the present overhead guide channel stabilizer member illustrated in FIG. 1.

Referring to FIG. 2, the present guide channel stabilizer member 16 is of generally planar, rectangular construction and includes an upper wall member 39 having front and rear edge portions 40 and 42, side edge portions 44 and 46, and top and bottom surfaces 48 and 50. The present stabilizer member 16 further includes a plurality of elongated, parallel guide wall members 52 extending downwardly from bottom surface 50 of member 39 in spaced relation to one another. Guide wall members 52 define a plurality of guide channels 54 therebetween extending the full length of stabilizer member 16 from front edge 40 to rear edge 42. For reasons discussed below, each guide channel 54 has a width dimension which is measured between respective adjacent guide wall members 52, and a height dimension as measured between the distal or bottom most end portion 56 of each guide wall member 52 and the bottom surface 50 of upper wall member 39. These width and height dimensions should be sufficiently large to enable the guide channels 54 to receive the upper portions of the product containers to be located and supported on shelf member 14 below, yet still allow free movement of such product containers within each respective guide channel 54. Guide channels 54 are likewise open at both opposite ends thereof adjacent front and rear edge portions 40 and 42 respectively to enable free and easy placement of product containers within each respective guide channel 54 as well as free and easy removal therefrom.

Figure 3:
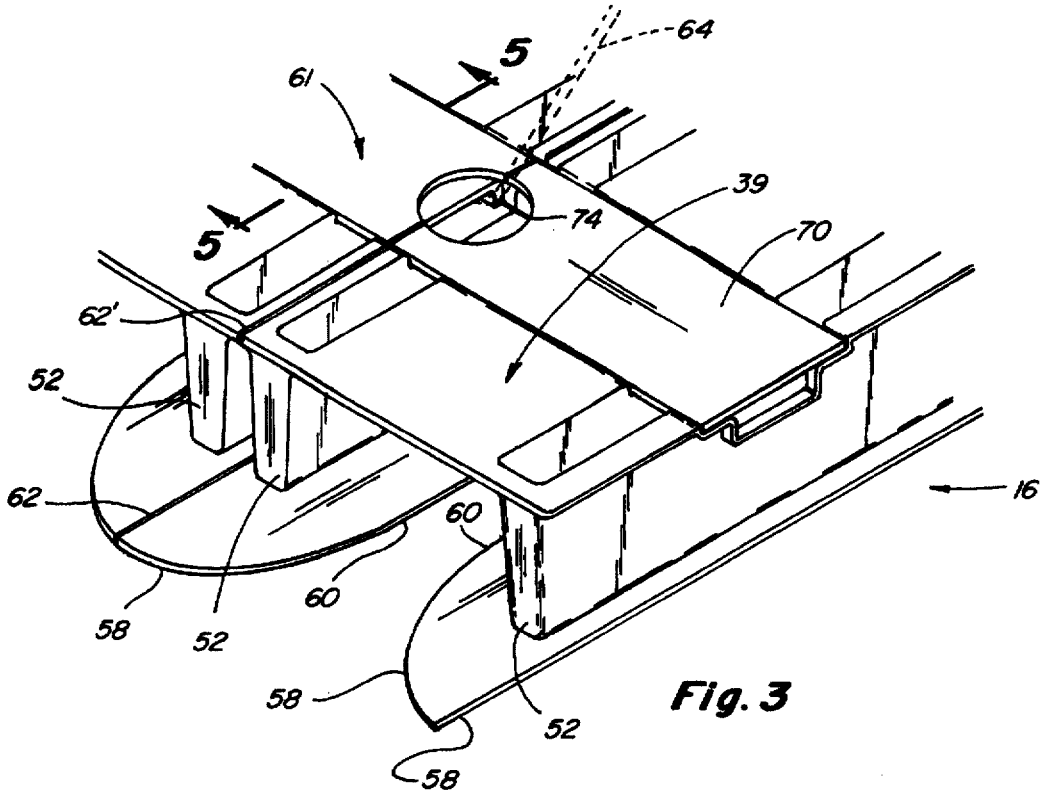
FIG. 3 is an enlarged partial perspective view of the present guide channel stabilizer member of FIGS. 1 and 2 showing stiffening means associated therewith as well as suspension means for attaching the present stabilizer member to a product merchandising display unit.

Guide wall members 52 can each additionally include guide rail or flange members 58 as best shown in FIGS. 2 and 3, the members 58 being mounted to the respective distal end portions 56 of each guide wall member 52. Guide rail members 58 are each of substantially planar construction and each extends a short distance into its corresponding guide channel 54 as well as beyond the opposite end portions of the respective guide wall members 52 as illustrated. In this regard, the guide rail members 58 associated with the intermediate guide wall member 52 are mounted and configured so as to extend into the corresponding guide channels 54 on each opposite side thereof. Each guide rail member 58 also includes an edge portion 60 extending completely therearound, which edge 60 is positionable adjacent the upper portion of product containers located in guide channels 54 for containing and controlling the movement of such product containers as will be explained. Importantly, guide rail members 58 can be provided in differing widths as measured between the opposed edge portions 60 thereof so as to enable utilizing the members 58 for controlling the width associated with guide channels 54 independent of guide wall members 52. In this regard, guide rail members 58 can be provided in differing predetermined widths corresponding to the different widths of the upper portions of a wide variety of product containers. For example, some product containers, particularly soft drink containers, have neck and cap portions of varying sizes. Note also that the end portions of guide rail members 58 extend outwardly beyond the respective end portions of guide wall members 52 and each has a rounded, beveled, or similar shape. This is to facilitate product loading and removal from the unit 10. In this regard, the front and rear portions of the stabilizer member 16, including the shape and construction of the from and rear edge portions 40 and 42, the respective guide member end portions, and the rounded or beveled end portion shape of the rail members 58 are substantially identical and, as such, such front and rear portions of the member 16 are interchangeable. This means that the present stabilizer member 16 can be mounted within existing equipment with either end portion extending towards the front of the unit 10. This not only facilities installation, but it also further facilitates product loading and removal since products can be both loaded and removed from either end of the stabilizer member 16.

It is also important to recognize that guide rail members 58 are utilized merely for providing lateral support and guiding the movement of product containers actually positioned and supported on shelf member 14 located therebelow and thus the product containers are in no way suspended or completely supported by guide rail members 58 alone. This is an important feature of the present invention as it enables the stabilizer member 16 to be of relatively light weight, inexpensive construction, and it enables existing shelving units to be easily retrofitted with the present stabilizer means without requiring the existing shelving units to be taken out of service, and without requiring products located and displayed for sale on such existing units to be removed for installation of the present stabilizer member 16. The present stabilizer member 16 must work in cooperation with a product support area such as a shelf member 14 to achieve its stated purpose.

Referring to FIG. 3, the guide channel stabilizer member 16 can also be optionally provided with frangible means such as frangible means 62 and 62' (FIGS. 2 and 3) adjacent one or both side portions of the member 16 to enable the breaking off of one or more guide wall members 52 so as to reduce the width of the stabilizer member to suit a particular application. As illustrated in FIG. 2, the stabilizer member 16 is width adjustable and includes a pair of frangible or detachable side portions 61 and 63. The frangible side portion 61 is defined by and between the side edge portion 46 of the upper member 39 and scored or weakened fraction lines 62 and 62', the fracture line 62 extending the entire length of guide rail member 58 as illustrated and fracture line 62' extending the entire depth of the upper member 39 between front and rear edge portions 40 and 42. More particularly, the fracture line 62 includes a molded thin walled section of reduced cross-sectional area, or other fracture or perforation means, and extends the full length of guide rail member 58, at the center portion thereof, adjacent to and between the pair of guide wall members 52 to which it is attached as shown in FIGS. 2 and 3. Similarly, the fracture line 62' includes a molded thin walled section of reduced cross-sectional area, or other weakening or perforations means, and likewise extends adjacent to and between the pair of guide wall members 52 along the full length of the upper member 39 as best shown in FIG. 3. In this regard, it should be noted that the construction of the guide wall members 52 which accommodate the fracture means 62 and 62' is somewhat different as compared to the construction of the other intermediate guide wall member 52 in that such guide wall construction includes a pair of guide wall members 52 arranged in a somewhat U-shaped configuration so as to accommodate the weakening means 62 and 62' therebetween. Fracturing both weakening means 62 and 62' will enable frangible side portion 61 to be severed from the remainder of member 16 still leaving a usable guide channel 54 adjacent the fracture lines 62 and 62'.

The frangible side portion 63 is similarly located at the opposite side of the stabilizer member 16 and is similarly defined by and between the side edge portion 44 of the upper member 39 and a pair of weakened fracture lines 62 and 62' positioned and located in the same manner as previously defined with respect to frangible side portion 61. Either one or both of the frangible side portions 61 and 63 may be easily detachably removed from the structure 16 so as to narrow the width thereof. This facilitates using the present stabilizer member 16 on shelves or other product support areas having varying widths and therefore substantially increases the usefulness and marketability of such member.

The procedure of fracturing and removing, for example, frangible side portion 61 (FIG. 3) can be easily accomplished by placing the member 16 on a flat support surface such as a table or desk and positioning the member 16 such that the fracture lines 62 and 62' associated therewith extending along an edge of the table or other supporting surface. By pressing downwardly on the portion 61, the side portion 61 can be broken and easily tom therefrom. The molded thin walled section associated with the respective fracture lines not only provide the snap off capability of the side portions 61 and 63 but also provide adequate strength to mitigate against accidental breakage of the frangible side portions which is a problem with known units that have removal sections. In some cases, a tool having a sharp edge portion may be utilized to facilitate the fracturing process. Weakening the member 16 such as at the fracture lines 62 and 62' in accordance with the subject invention facilitates breaking off portions only along such fracture lines and prevents damages to the newly formed side edges.

Figure 5:
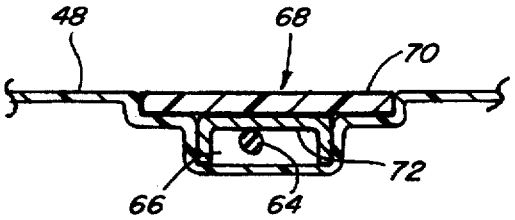
FIG. 5 is a cross-sectional view taken along line 5—5 of FIG. 3 showing passage of the suspension means through the stabilizer member and the stiffening means associated therewith.
Figure 4:
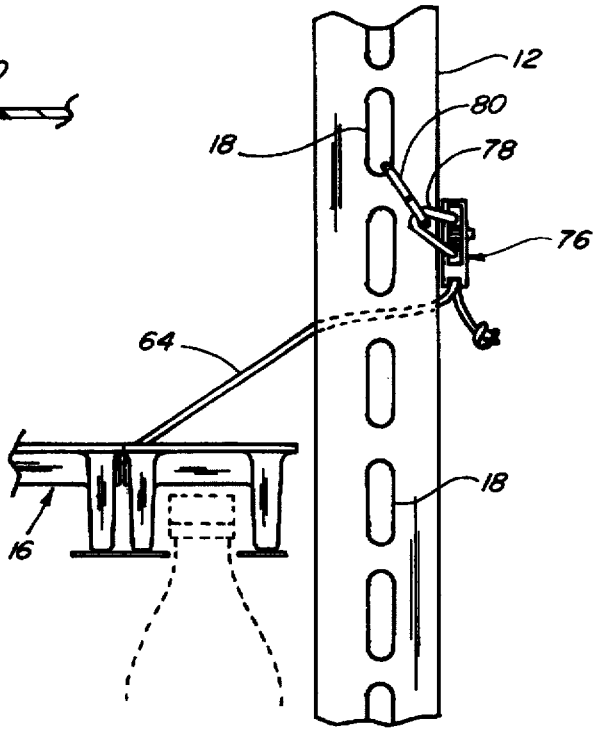
FIG. 4 is an enlarged fragmentary side elevational view of one of the upright support members associated with a typical prior art product merchandising display unit showing the present suspension means and the adjustment means associated therewith.
Figure 6:
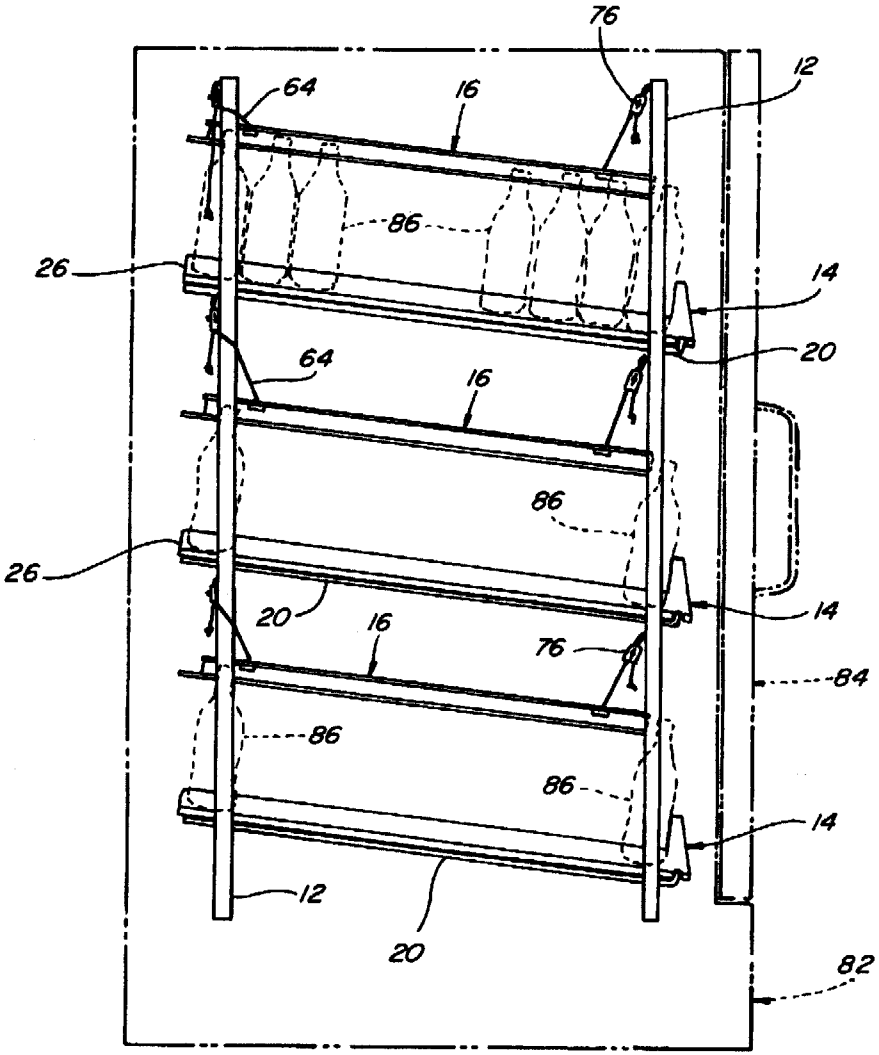
FIG. 6 is a side elevational view showing a plurality of the present guide channel stabilizer members mounted in a typical prior art refrigerated cooler assembly in an inclined gravity feed orientation, a plurality of soft drink bottle containers also being shown in dotted outline form in operative position on the respective shelf members located therebelow.

The present guide channel stabilizer member 16 also includes adjustable mounting means which enables the member 16 to be easily and quickly positioned at different heights or elevations above shelf member 14. The adjustable mounting means illustrated herein include a pair of suspension cords 64 having their respective end portions positioned respectively in the vicinity of the respective four comers of the member 16 as best shown in FIG. 1, each respective cord end portion attaching to a corresponding upstanding support member 12 for suspending the stabilizer member above the shelf member 14 as shown in FIGS. 1 and 6. Referring more particularly to FIGS. 1, 4 and 5, the present guide channel stabilizer member 16 includes a single suspension cord 64 positioned in spaced relationship to the front portion of the member 16, and a single suspension cord 64 positioned in spaced relationship to the rear portion thereof. Each respective suspension cord 64 is mounted through a separate internal passageway 66 extending transversely through member 16 at spaced locations from the front and rear edge portions thereof, each transverse passageway 66 being positioned under a reinforcing rib assembly 68 as best shown in FIG. 5. As best shown in FIGS. 2 and 5, each reinforcing rib assembly 68 includes an elongated, flat top plate member 70 constructed of a plastic material and a metal U-shaped channel member 72. Plate members 70 extend the entire width of member 16, whereas U-shaped channel members 72 terminate adjacent spaced openings 74 formed in the respective plate members 70 at locations corresponding to frangible means 62 and 62'. The opposite end portions of suspension cords 64 emerge from their respective internal passageways 66 through openings 74 and wrap partially around the corresponding adjacent support member 12. The suspension cords 64 are positioned and located so as to carry the weight of the entire unit along the length of the reinforcing rib assemblies 68.

Each opposite end portion of both suspension cords 64 includes a manually adjustable cinching device 76 as best shown in FIG. 4. Cinching device 76 forms a loop 78 in the cord 64, which loop 78 receives one end of a hook member 80, the opposite end of hook member 80 being insertable into any one of the slots 18 associated with the respective upstanding support members 12 for suspending the stabilizer member 16 therefrom. The height of the stabilizer member 16 above shelf member 14 can be varied by manipulating the cinching devices 76 so as to vary the size of the loops 78.

FIG. 6 illustrates use of a plurality of the present guide channel stabilizer members 16 in a typical refrigerated display cooler 82 having upright support members 12 and a plurality of shelf members 14 associated therewith, the shelf members 14 being supported on shelf support structures 20 which are selectively positionable at various intermediate locations along the length of support members 12. The cooler 82 is representative of a wide variety of product display coolers presently in use and includes a front glass door 84 which provides product visibility and access for consumers. Products typically merchandised and displayed in such coolers such as the soft drink bottle containers 86 are shown in dotted outline form. The shelf members 14 and the stabilizer members 16 are shown in a gravity feed orientation as illustrated. In this regard, it should also be noted that shelf members 14 as well as stabilizer members 16 could likewise be oriented horizontally for non-gravity feed operation. In either orientation, shelf members 14 can be stocked form either the front or the rear of cooler 82. Regardless of whether shelf members 14 are set up in a horizontal or gravity feed orientation, guide channel stabilizer members 16 can be positioned at a desired height above shelf members 14 simply by adjusting the length of suspension cords 64 using cinching devices 76 as previously explained. In this manner, for example, a particular shelf member 14 and associated stabilizer member 16 can be spaced for holding and guiding the movement of bottled containers of one height or style, while another shelf member 14 and associated stabilizer member 16 can be adjusted for accommodating bottled containers of another height or style.

Figure 7:
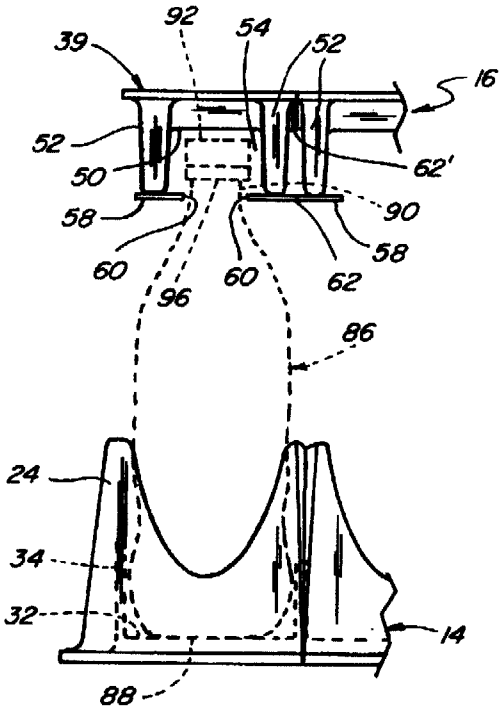
FIG. 7 is an enlarged fragmentary front elevational view of a representative shelf member associated with the cooler assembly illustrated in FIG. 6 illustrating the relationship between the present stabilizer member and a typical soft drink container positioned thereon.

FIG. 7 illustrates more closely how the present guide channel stabilizer members 16 cooperate with product holding areas such as the shelf members 14 to contain and provide lateral support for the product containers 86 supported thereon. As can be seen, the bottom portion 88 of bottle container 86 rests in channel 36 on floor 32 of shelf member 14. As will be recalled from the discussion above, channel 36 of shelf member 14 is defined by shelf guide members 34 (FIG. 1), which shelf guide members 34 are relatively short members adequate to provide sufficient lateral support for relatively short product containers such as more conventional soft drink bottles which are shorter in overall height than bottle containers 86. As such, guide members 34 provide only minimal lateral support for the relatively taller bottle containers 86. A guide channel stabilizer member 16, when positioned in spaced relationship above shelf member 14 such that stabilizer guide channels 54 are located in spaced alignment above shelf channels 36, provides the necessary lateral support for preventing taller product containers from tipping or toppling over the shorter shelf divider walls 34. The stabilizer member 16 also serves to guide the movement of the bottle containers 86 along shelf channels 36. In this regard, it has been found that suspending stabilizer member 16 such that the edges 60 of opposed guide rails 58 are located on opposite sides of bottle neck 90 just beneath bottle closure 92 provides adequate support for bottle containers 86 without binding or inhibiting free movement of the bottle in guide channels 36 and 54. It is important to note that guide rail edge portions 60 and bottom surface 50 of upper member 39 are located in slightly spaced relationship to the neck 90 and the cap 92 of bottle container 86. This spacing arrangement ensures relatively free movement of the bottle 86 while preventing it from tipping or toppling over shelf divider walls or guide members 34.

Figure 8:
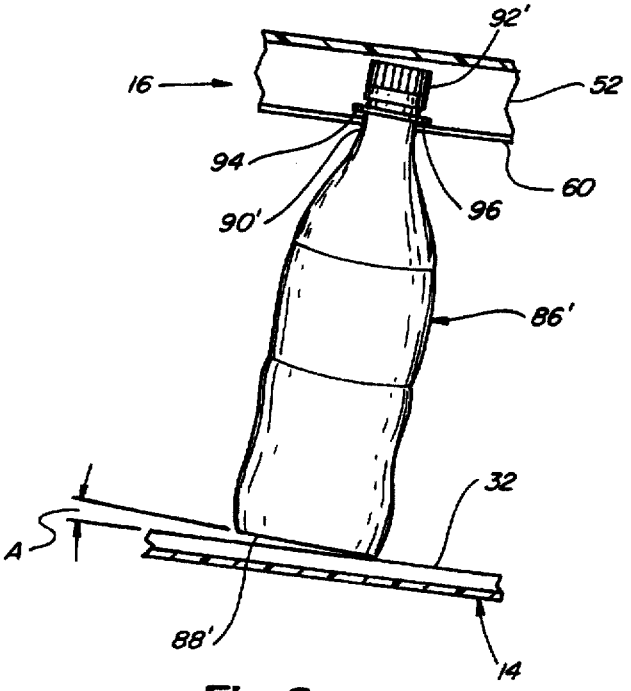
FIG. 8 is an enlarged fragmentary side elevational view of the shelf stabilizer arrangement illustrated in FIG. 7 showing a soft drink bottle container restrained from tipping over in the direction of travel due to the present guide channel stabilizer member.

FIG. 8 is a side elevational view showing a typical bottle container 86' supported on shelf member 14 wherein bottle 86' is beginning to tip forward, for whatever reason, such that the bottom portion 88' of bottle 86' is oriented at a small acute angle A with respect to shelf floor 32. This situation commonly arises in many different merchandising applications with shelf member 14 oriented in a gravity feed orientation, as shown, as well as in a horizontal orientation. Relatively tall product containers such as the bottle containers 86' have more of a tendency to tip in the manner shown due to their height and weight, and such tipping frequently occurs when an adjacent bottle is removed by a consumer and/or during restocking. Stabilizer guide rails 58, due to their opposed spacing, allow the free movement of the bottle neck portion 90' therebetween. In contrast, however, the opposed spacing between stabilizer guide rail edge portions 60 will not allow passage of the bottle cap member 92' therethrough and, in some bottle configurations, such spacing will likewise not allow passage of an annular flange member 94 located below the cap member 92'. This constructional configuration serves to prevent bottle containers 86' from tipping completely over because the edge or lip 96 that forms a part of either bottle closure 92', or flange member 94 located immediately therebelow, will catch on guide rails 60 to support the bottom of the container, while still enabling some slidable movement of the bottle 86' within the shelf guide channels 36.

Figure 9:
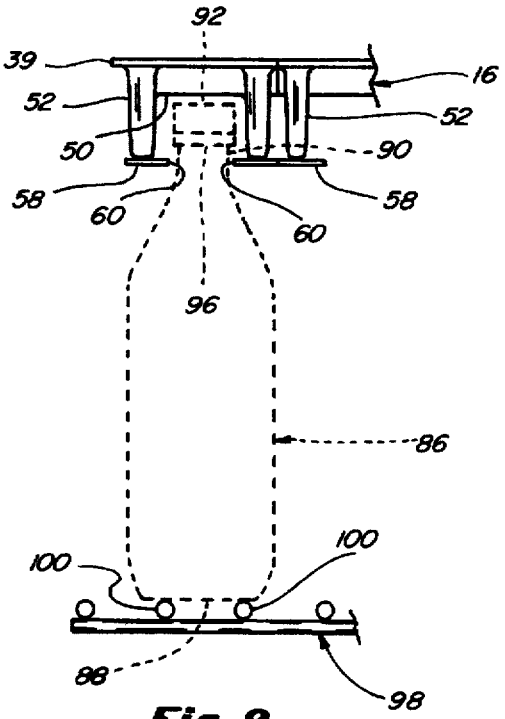
FIG. 9 is an enlarged fragmentary front elevational view illustrating use of the present guide channel stabilizer member in association with a wire shelf member.

FIG. 9 shows the present guide channel stabilizer member 16 in association with an alternative product support means 98, which product support means is a shelf member 98 of wire construction including elongated support rails 100 for supporting product containers such as the soft drink bottle containers 86 and 86' already illustrated. Stabilizer member 16 operates in conjunction with wire shelf 98 in the same manner as described above. With the bottom 88 of bottle 86 supported on support rails 100 and stabilizer member 16 suspended in the above described manner above shelf member 98, bottle closure 92 as well as a portion of bottle neck 90 will be located in stabilizer guide channel 54. Although shelf member 98 provides no lateral guide channel means such as the shelf guide members 34 of previously described shelf member 14, stabilizer guide rails 58 will be sufficient to maintain bottle 86 in an upright position on support member 98 and guide the movement of such containers therealong in guide channel 54 by occasional engagement of stabilizer guide rail edges 60 with bottle neck portion 90 in the event bottle 86 begins to move or topple in a lateral direction. Additionally, as explained with regard to FIG. 8 above, in the event bottle container 86 begins to tip forwardly in the direction of travel in guide channel 54, stabilizer guide rails 58 will engage the lower lip or edge 96 of bottle 86 thereby preventing it from toppling completely over. It is recognized that a wide variety of different types of wire and/or rod type product support structures are available and in use, and the present stabilizer member 16 is adaptable for use with all such varying product support areas.

Figure 10:
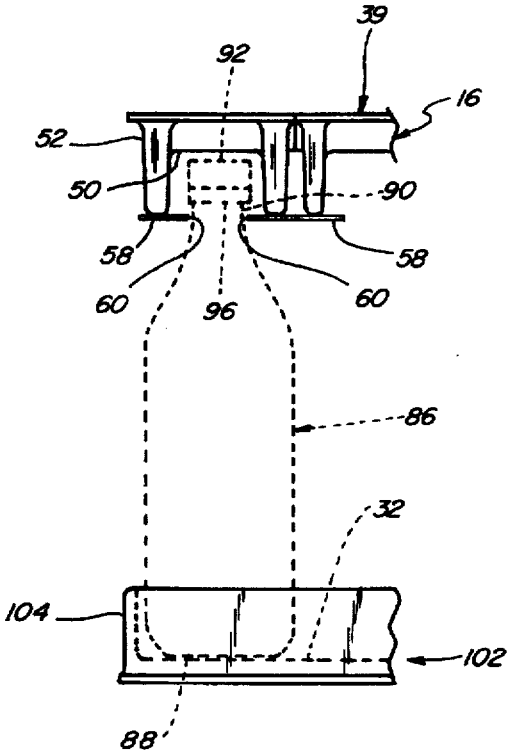
FIG. 10 is an enlarged fragmentary front elevational view illustrating use of the present guide channel stabilizer member in association with an undivided shelf member construction utilizing no divider wall or guide channel means.

Referring to FIG. 10, the present guide channel stabilizer member 16 is still further shown in use in association with a shelf member 102, shelf member 102 being an undivided product merchandising shelf member having no divider walls segregating the unit into separate channels. Product merchandising shelf member 102 includes a planar floor portion 32 surrounded only by a relatively short upstanding side wall 104 and thus provides virtually no lateral support whatsoever for product containers positioned thereon. Nevertheless, by utilizing stabilizer member 16 in conjunction with undivided shelf member 102, relatively tall product containers such as the tall soft drink bottle containers 86 can be maintained in an upright orientation on such shelf member and can be guided in orderly rows as previously explained with respect to FIG. 9.

It is important to note and recognize that the spacing between the stabilizer guide rail edges 60 can be varied from channel to channel in order to accommodate the many different styles and sizes of bottle containers presently being utilized by the soft drink industry. This spacing can be varied by fabricating the present stabilizer member 16 with differently sized guide rail members 58. The width of each such guide rail member 58 determining the spacing between each respective pair of opposed guide rail edges 60. It is also recognized and anticipated that the guide rail members 58 can be constructed so as to be removably detachable in the field so that differently sized guide rail members 58 can be retrofitted to such units to change the spacing between opposed guide rail edges 60 as need during use. Still further, it is also recognized and anticipated that the present stabilizer member 16 will also function and operate as explained above without the use of guide rail members 58. In this situation, the spacing between the stabilizer guide wall members 52 will determine the particular size and style of product container which can be insertably received and guided therebetween. In this particular configuration, the stabilizer member 16 can be fabricated with the guide wall members 52 spaced at predetermined widths so as to accommodate different product containers. It is also important to note that the overall dimensions of the stabilizer member 16 as well as the specific shape and configuration of the various members comprising the stabilizer structure 16 such as the upper member 39, the guide wall members 52, the guide rail members 58, the reinforcing assembly 68, and the suspension means 64 and 76 are subject to wide variations and may be sized and shaped into a variety of different sizes and configurations so as to be compatible with the size and shape of the particular product merchandising display device into which the present stabilizer structure 16 may be mounted, or to conform with any other space limitation, without impairing the teachings and practice of the present invention.

Thus there as been shown and described several embodiments of a guide channel stabilizer means for use in association with existing product merchandising and display equipment, including refrigerated coolers, which stabilizer means fulfill all of the objects and advantages sought therefore. Many changes, modifications, variations and other uses and applications of the present constructions, will, however, become apparent to those skilled in the art after considering this specification and the accompany drawings. All such changes, modifications, variations and other uses and applications which do not depart from the sprit and scope of the invention are deemed to be covered by the invention which is limited only by the claims which follow.

What is claimed is:

1. In a product merchandising display unit having a plurality of substantially upright support means associated therewith and at least one product holding support member for supporting products positioned thereon in a generally co-planar relationship, the improvement comprising:

guide stabilizer means positionable above the product holding support member, said guide stabilizer means including at least one pair of opposed parallel stabilizer members defining a guide channel therebetween adaptable for receiving and containing at least a portion of the upper portions of products positioned on the product holding support member, and means for mounting said guide stabilizer means within the product merchandising display unit in spaced apart relationship above the product holding support member, said guide stabilizer means working in cooperation with the product holding support member to guide the movement of products positioned thereon, said guide stabilizer means being further independently movable within the product merchandising display unit without affecting the position and location of any product holding support member associated therewith.

2. The improvement defined in claim 1 wherein each of the upright support means associated with the product merchandising display unit includes a plurality of spaced attachment means, said means for mounting said guide stabilizer means within the product merchandising display unit including a plurality of hook members, each of said hook members having a portion thereof engageable with a selected one of the spaced attachment means associated with the upright support means.

3. The improvement defined in claim 2 wherein said plurality of hook members are selectively engageable with the upright support means so as to orient said guide stabilizer means in either a substantially flat horizontal position or an inclined position for gravity feed operations.

4. The improvement defined in claim 1 wherein said guide stabilizer means includes a plurality of spaced opposed parallel stabilizer members defining a plurality of parallel guide channels adaptable for receiving and containing at least a portion of the upper portions of products positioned on the product holding support member.

5. The improvement defined in claim 4 including means for weakening said guide stabilizer means adjacent to at least one of said stabilizer members whereby said guide stabilizer means can be broken along said weakening means into separate portions on opposite sides thereof.

6. The improvement defined in claim 1 wherein said product holding support member includes a substantially flat planar floor member.

7. The improvement defined in claim 1 wherein said product holding support member includes a wire frame member.

8. The improvement defined in claim 1 wherein said product holding support member includes a shelf member having a plurality of upstanding divider wall portions defining therebetween a plurality of adjacent product channels for receiving and organizing products positioned therewithin in parallel rows.

9. The improvement defined in claim 1 wherein said product holding support member includes an undivided shelf member.

10. A guide channel stabilizer structure for use in combination with product merchandising display equipment wherein the product merchandising display equipment includes a plurality of vertical support members and a plurality of product support areas, said guide channel stabilizer structure comprising a plurality of spaced apart, parallel guide members defining a plurality of parallel adjacent guide channels for receiving and guiding the upper portions of product containers when said product containers are positioned and supported on one of said product support areas, means engageable with said guide channel stabilizer structure and with the vertical support members of the product merchandising display equipment for mounting said stabilizer structure within the product merchandising display equipment, said stabilizer structure being positioned and located in spaced apart relationship above any one of said product support areas such that the upper portions of the product containers positioned on the product support area located therebelow will lie within said stabilizer guide channels when positioned thereon, said stabilizer structure working in cooperation with the product support area located therebelow to provide sideward support for the product containers positioned within said stabilizer channels, said stabilizer structure being independently mountable and adjustable between any two spaced apart product support areas without affecting the position and location of such product support areas.

11. The guide channel stabilizer structure defined in claim 10 wherein at least some of said stabilizer guide members are frangibly attached to other stabilizer guide members so as to enable detachment thereof.

12. The guide channel stabilizer structure defined in claim 10 wherein said means for mounting said stabilizer structure within the product merchandising display equipment includes adjustable means for varying the height of said stabilizer structure above any one of said product support areas.

13. The guide channel stabilizer structure defined in claim 10 wherein said stabilizer structure and the product support area located therebelow are oriented in an inclined position for gravity feed operations.

14. In a product merchandising display unit having at least one shelf member associated therewith and a plurality of elongated support members positioned in an upstanding orientation at spaced locations around said shelf member, the upright elongated support members being attached in supportive relationship to said shelf member and extending upwardly therefrom, said shelf member being adaptable for holding and supporting a plurality of bottle containers in an upright orientation when positioned thereon, the improvement comprising a guide member adaptable for attachment to the product merchandising display unit so as to be positioned in spaced apart relationship above said shelf member, said guide member including a plurality of spaced divider wall portions defining therebetween a plurality of parallel guide channels for guiding and providing sideward support for the upper portions of bottle containers positioned therewithin, and means supportably attaching said guide member to at least some of the upright support members in spaced apart relationship above said shelf member, said guide member being located such that at least the upper neck portion of the bottled containers positioned on the shelf member therebelow will extend into and be received by the parallel guide channels of said guide member when such bottle containers are positioned and located thereon, said plurality of parallel guide channels guiding the movement of the bottled containers on said shelf member in orderly rows therealong, said attachment means being independent of said shelf member and allowing installation and adjustment of the position of said guide member above said shelf member without affecting the position and location of any shelf member.

15. The improvement defined in claim 14 wherein each respective guide channel includes a pair of spaced apart opposed flange members defining a space therebetween for receiving the upper portions of the bottle containers positioned therebetween, said space between said opposed flange members determining the particular size of bottle container adaptable for use with said guide member.

* * * * *

UNITED STATES PATENT AND TRADEMARK OFFICE

CERTIFICATE OF CORRECTION

PATENT NO. : 5,706,956

DATED : Jan. 13, 1998

INVENTOR(S) : Jonathan L. Headrick, et al

It is certified that error appears in the above-identified patent and that said Letters Patent is hereby corrected as shown below:

Column 7, line 44, "from" should be --front--.

Column 8, line 62, "tom" should be --torn--.

Signed and Sealed this

Twenty-first Day of April, 1998

Bruce Lehman

*Attest:*

BRUCE LEHMAN

*Attesting Officer*

*Commissioner of Patents and Trademarks*